United States Patent [19]

Chu et al.

[11] Patent Number: 4,592,828

[45] Date of Patent: Jun. 3, 1986

[54] PROCESS FOR UPGRADING PETROLEUM RESIDUA

[75] Inventors: Yung F. Chu; Stuart S. Shih, both of Cherry Hill, N.J.

[73] Assignee: Mobil Oil Corporation, New York, N.Y.

[21] Appl. No.: 607,373

[22] Filed: May 7, 1984

[51] Int. Cl.[4] ..... C10G 65/04; C10G 65/12

[52] U.S. Cl. ..... 208/89; 208/111; 208/210; 208/213; 208/217

[58] Field of Search ..... 208/59, 89, 111, 210, 208/213, 216 R, 217

[56] References Cited

U.S. PATENT DOCUMENTS

| | | | |
|---|---|---|---|
| 3,444,071 | 5/1969 | Langhout | 208/59 |
| 3,539,495 | 11/1970 | Egan | 208/59 |
| 3,691,152 | 9/1972 | Nelson et al. | 208/210 |
| 3,788,972 | 1/1974 | Henry et al. | 208/59 |
| 3,790,472 | 2/1974 | White | 208/111 |
| 4,372,839 | 2/1983 | Oleck et al. | 208/59 |
| 4,419,220 | 12/1983 | LaPierre et al. | 208/111 |
| 4,428,862 | 1/1984 | Ward et al. | 502/77 |
| 4,501,653 | 2/1985 | Hamner | 208/89 |
| 4,517,074 | 5/1985 | Ward | 208/111 |
| 4,519,900 | 5/1985 | Angevine et al. | 208/217 |

*Primary Examiner*—John Doll
*Assistant Examiner*—O. Chaudhuri
*Attorney, Agent, or Firm*—Alexander J. McKillop; Michael G. Gilman

[57] ABSTRACT

Petroleum resid is upgraded in an improved process to produce a low pour point 650°-775° F. fraction without disturbing the product characteristics of other distillate boiling range fractions. The 650°-775° F. fraction is dewaxed separately from the remaining hydrodesulfurized product.

15 Claims, 1 Drawing Figure

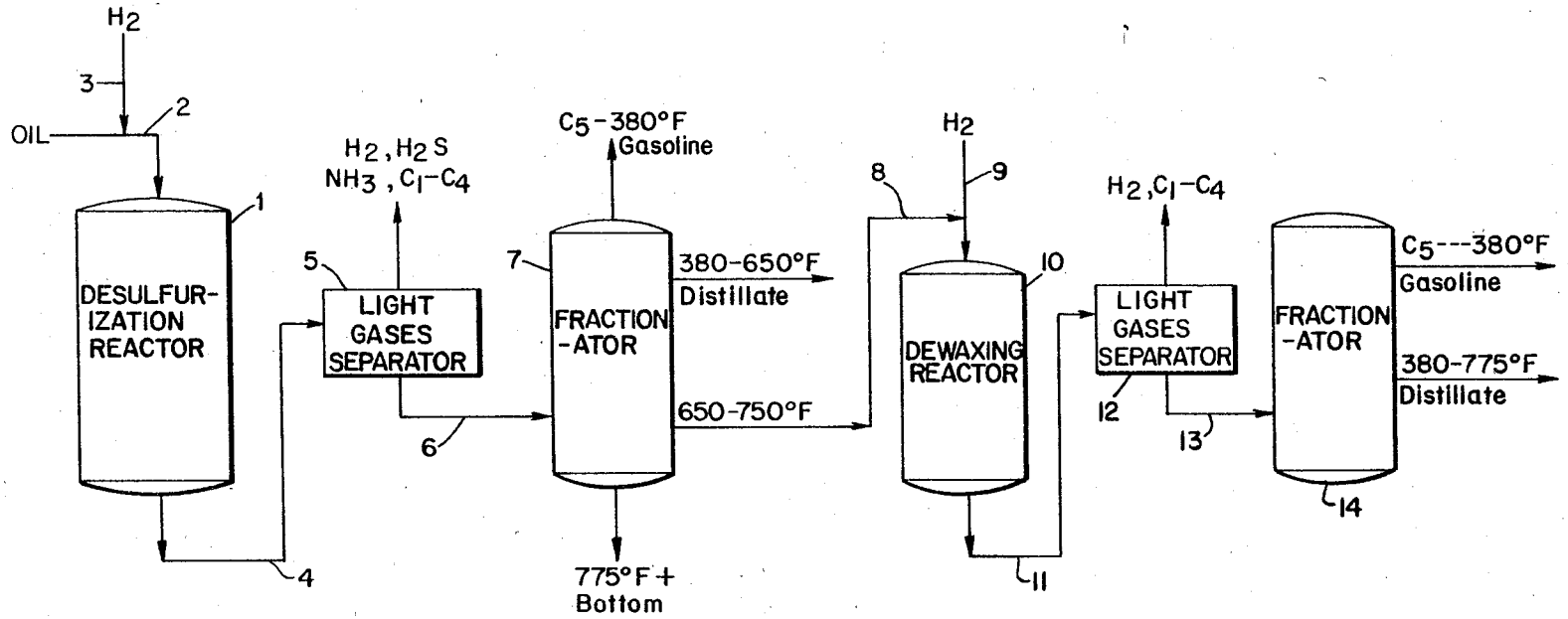
OIL
H2
3
2
DESULFUR-IZATION REACTOR
1
4
LIGHT GASES SEPARATOR
5
H2, H2S NH3, C1-C4
6
FRACTION-ATOR
7
C5-380°F Gasoline
380-650°F Distillate
650-750°F
775°F+ Bottom
8
H2
9
DEWAXING REACTOR
10
11
LIGHT GASES SEPARATOR
12
H2, C1-C4
13
FRACTION-ATOR
14
C5--380°F Gasoline
380-775°F Distillate

PROCESS FOR UPGRADING PETROLEUM RESIDUA

FIELD OF THE INVENTION

This invention is concerned with upgrading petroleum resid and, more particulary, with inincreasing the quantity and quality of the hydrocarbon distillate fraction boiling above 330° F.+ and useful as fuel obtained from petroleum residua by a combined process of hydrodesulfurization and catalytic dewaxing.

BACKGROUND OF THE INVENTION

It has long been recognized that long straight chain paraffin hydrocarbons containing upwards of about 18 carbon atoms will crystallize from a solution in petroleum hydrocarbons at substantially lower temperatures than the freeze-point of other hydrocarbons of like boiling point. A fraction separated from a waxy crude oil by distillation will become incapable of flow from a vessel at a temperature (the pour point) such that the wax crystals formed will inhibit such flow. Liquid fuels cannot be used in the intended manner at temperatures below the pour point. Difficulties due to poor pumpability and clogging of filters can be encountered at higher temperatures due to suspended wax crystals in the soil.

Dewaxing of hydrocarbon oils has been practiced for many years by chilling the oil, usually in a solvent, and separating the wax crystals, as by filters, centrifuges, and the like. A more recent development for reducing the pour point of hydrocarbon fractions is catalytic hydrodewaxing in which a mixture of hydrogen and waxy hydrocarbon fractions is contacted at conversion conditions of temperature and pressure with a shape selective porous solid catalyst having acid activity for cracking in combination with a metallic hydrogenation/dehydrogenation catalyst. The porous solid catalyst is characterized by uniform pores which will admit only straight chain or straight and slightly branced chain aliphatic compounds and therefore converts only those compounds so admitted. Typical dewaxing catalysts include crystalline zeolites which are shape selective, i.e., capable of selectively cracking the waxy paraffinic constituents of the feed without excessive cracking of larger moclecules. Such zeolites are characterized by a constraint index of 1–12. In some instances, the dewaxing catalyst may be used without hydrogenation/-dehydrogenation metal functions.

In addition to catalytic hydrodewaxing which is a shape selective cracking process, heavy hydrocarbon stocks, particularly those containing sulfur, nitrogen, and metal contaminants have been converted to provide good yields of such premium products as motor gasoline, diesel fuel, jet fuel, distillate fuel oil, and kerosene as well as heavier (higher molecular weight) products suitable for blending with the premium products by catalytic cracking or hydrocracking the feedstock to lower molecular weight materials to reduce the boiling point of the constituents of the heavy stocks. The sulfur content of heavy fractions from many crudes, however, exceeds environmentally acceptable limits. This characteristic of heavy crude fractions is usually handled by hydrodesulfurization, a catalytic reaction under hydrogen pressure in the presence of a catalyst having hydrogenation/dehydrogenation activity such as cobalt and molybdenum oxides or sulfides on a refractory support such as alumina.

Thus, it has become common practice to hydrotreat certain stocks for removal of sulfur, nitrogen, and metals. For example, feed for hydrocracking may be first contacted with a hydrotreating catalyst as discussed above in the presence of hydrogen. The hydrotreater effluent is condensed and separated from unused hydrogen, ammonia, hydrogen sulfide and gaseous hydrocarbons such as methane for recycle to the reactor after scrubbing to remove hydrogen sulfide and ammonia. The condensate is then mixed with a further supply of hydrogen and passed through one or more beds of hydrocracking catalysts to produce products of lower boiling range than the feed. Similarly, a catalytically hydrodesulfurized chargestock can be shape selectively hydrocracked, i.e., dewaxed. Further, it has been proposed to simultaneously dewax and desulfurize a resid at conventional resid desulfurization conditions using a combined hydrotreating/ZSM-5 zeolite catalyst.

What has been found, however, is that when the single-catalyst systems such as just described above is used simultaneously for hydrotreating and dewaxing an atmospheric resid, a low sulfur 775° F.+ bottom fraction and a low sulfur, low pour point 650°–775° F. fraction are produced that could be blended to the refinery distillate pool, but the kinematic viscosity of the 775° F.+ bottom fraction is excessively high making this bottom fraction unsuitable for a heavy fuel oil application. A more expensive cutter stock must be used for blending, but such use of blending stocks penalizes the process economics. Furthermore, it was found that the pour point reductions of the 380°–650° F. and 650°–775° F. fractions were much greater than the reductions required by product specifications. Moreover, the 380°–650° F. and 775+° F. fractions from a conventional hydrodesulfurization unit without dewaxing function have been found to meet the product specifications. Thus, it would appear desirable to dewax the 650°–775° F. fraction alone.

Accordingly, it is an object of the present invention to upgrade a petroleum resid by desulfurizing such resid and subsequently treating the 650°–775° F. fraction alone, thus leaving undisturbed hydrocarbon distillate boiling below 650° F. and above 775° F.

SUMMARY OF THE INVENTION

In accordance with the present invention, a reactor system is provided subsequent to a conconventional desulfurization unit to catalytically dewax only the 650°–775° F. fraction obtained from the desulfurization unit. The hydrocarbon fraction boiling in the range of 650°–775° F. is obtained by fractionating the desulfurized resid.

BRIEF DESCRIPTION OF THE FIGURE

The FIGURE is a schematic diagram illustrating the process of the present invention.

DETAILED DESCRIPTION OF THE INVENTION

The hydrocarbon chargestock to be treated in accordance with the present invention may be provided from a variety of sources. Preferably, the hydrocarbon chargestocks are comprised of an atmospheric or vacuum petroleum resid. Other applicable feedstocks include heavy whole petroleum crudes, as well as crudes derived from shale oil, tar sands, and the like as well as petroluem stocks derived from the liquefaction of coal.

The hydrodesulfurization process used in the present invention can be any conventionally known hydrodesulfurization process unit used in the art. For example, the catalyst used in the process can be any conventional hydrodesulfurizing catalyst, such as a catalyst comprising a group VIB (chromium, molybdenum, or tungsten) metal and a Group VIII metal or their oxides or sulfides. The metal catalysts are typically supported on a nonacidic support such as alumina. The hydrodesulfurization process is conducted with the catalyst under hydroprocessing conditions comprising a hydrogen pressure of about 600 psig to about 3000 psig, preferably about 1500 psig to 2500 psig; a temperature of about 650°-850° F., preferably about 700°-820° F.; a liquid hourly space velocity of 0.1-6.0, preferably 0.4-4.0. The hydrogen gas used in the process of hydrodesulfurization is circulated through the hydrodesulfurization reactor at a rate of between about 1000 and 15,000 scf/bbl of feed and preferably between about 1000-8000 scf/bbl. The hydrogen purity may vary from about 60-100%. If the hydrogen is recycled, as is customary, it is desirable to provide means of bleeding off a portion of the recycled gas and to add make-up hydrogen in order to maintain the hydrogen purity within the specified range. The recycled gas is usually washed with a chemical absorbent sulfide and ammonia or otherwise treated in a known manner to reduce the hydrogen sulfide and ammonia content thereof prior to recycling.

During desulfurizing, the heavy hydrocarbon stock is cracked into premium products such as motor gasoline, diesel fuel, jet fuel, distillate fuel oil, and kersosene. Generally, the product specifications such as sulfur content, pour point and viscosity of the distillate produced, in particular, the 380°-650° F. and 775° F.+ fractions are reached upon hydrodesulfurization. However, the 650°-775° F. fraction still contains excessive amounts of waxy parafins and thus the pour point of this fraction is above specification. Typically, such waxy 650°-775° F. fraction can only be used as low-value fuel oil. It is desirable to upgrade the 650°-775° F. fraction into low-pour, higher value distillate. It has been proposed to simultaneously dewax and desulfurize the resid at conventional resid desulfurization conditions using a combined hydrotreating/ZSM-5 zeolite catalyst. It has been found, however, that catalytic dewaxing of the whole desulfurized hydrocarbon distillate or using combined hydrotreating/ZSM-5 zeolite catalyst in a resid desulfurization reactor affects the various distillate boiling range fractions differently, and can adversely alter product characteristics. This can be seen from Example 1.

EXAMPLE 1

Two chargestocks were desulfurized at conventional resid desulfurization conditions with a desulfurization catalyst comprising 5% nickel oxide and 17% Molybdena on alumina. One of the chargestocks was treated with the hydrodesulfurization catalyst containing 15% by weight of a ZSM-5 dewaxing catalyst. The results are shown in Table 1.

TABLE 1

| Catalyst | Product Quality | | | |
|---|---|---|---|---|
| | Charge* | Charge** | 0% ZSM-5 | 15% ZSM-5 |
| A Pour Point, °F. | | | | |
| 380-650° F. | −15 | 5 | 10 | −65 |
| 650-775° F. | 60 | 60 | 60 | −45 |
| 775° F.+ | 45 | 70 | 30 | 20 |
| B Sulfur (Wt. %) | | | | |
| 650-775° F. | 2.2 | 2.12 | .17 | .28 |
| 775° F.+ | 3.3 | 3.13 | .48 | .73 |
| C KV (50° C.) cs | | | | |
| 775° F.+ | 700 | 700.7 | 313 | 580 |

*Feedstock for 15% ZSM-5 catalyst.
**Feedstock for 0% ZSM-5 catalyst.

As can be seen from Table 1, the pour point of the individual distillate fractions set forth were drastically reduced when the dewaxing catalyst was added to the desulfurization catalyst. Note, however, the change in kinematic viscosity of the 775° F.+ fraction when dewaxing is included with hydrodesulfurization. The dewaxed 775° F.+ fraction yielded a KV (50° C.) of 580 centistokes as compared to a KV of 313 centistokes upon desulfurization without dewaxing function, a twofold increase.

Example 2 illustrates that the direct addition of 15% ZSM-5 in a single catalyst system for simultaneous desulfurization and dewaxing increases the yields of gasoline and distillate by 5% and 14%, respectively, but that the gasoline gain is at the expense of the 650°-775° F. fraction that is normally obtained frm the desulfurization unit without dewaxing function.

EXAMPLE 2

Two feedstocks were hydrodesulfurized under conventional hydrodesulfurization conditions. One of the feedstocks was also contacted with 15% by weight ZSM-5 dewaxing catalyst combined with the desulfurization catalyst. Table 2 illustrates the product distributions of these treatments.

TABLE 2

| Catalyst | Process Yields | | | |
|---|---|---|---|---|
| | Charge* | Charge** | 0% ZSM-5 | 15% ZSM-5 |
| Product Distribution | | | | |
| $C_1$-$C_3$ | | | .39 | 3.01 |
| $C_4$ | | | .13 | 3.97 |
| $C_5$-380° F. | .8 | .79 | 2.41 | 7.17 |
| 380-650° F. | 20.0 | 11.79 | 19.92 | 19.99 |
| 650-775° F. | 16.7 | 15.80 | 22.3 | 14.12 |
| 775° F+ | 62.5 | 71.62 | 53.5 | 53.49 |
| $H_2$ Consumption (scf/bbl) | | | 600 | 637 |
| (1) Useful G + D ($C_5$-650° F.) | 20.8 | 12.58 | 22.3 | 27.2 |
| (2) Additional Dist. (0° F. Pour Point 650-775° F.) | | | | 14.1 |
| (3) Net G + D ((1) + (2)) | | | 22.3 | 41.3 |
| (4) Net G + D = (Total G + D - Useful G + D of charge) | | | 9.7 | 20.5 |

*Feedstock for 15% ZSM-5 catalyst (same as Table 1)
**Feedstock for 0% ZSM-5 catalyst (same as Table 1)

The above data illustrates that it would be advantageous to dewax only the distillate portion boiling in the range of about 650° to 775° F. obtained from the hydrodesulfurization of the resid. The distillate fractions boiling in the range of about 380° to 650° F. and that fraction boiling above about 775° F. fully meet product specifications upon hydrodesulfurization of the resid. Thus, in accordance with the present invention, the product leaving the hydrodesulfurization reactor is fractionated to separate the 650°–775° F. distillate boiling range fraction and this fraction alone is dewaxed under conventional hydrodewaxing conditions. The dewaxing conditions will include a temperature of 500° F. to about 950° F., preferably about 600° F. to about 870° F.; a hydrogen pressure of about 100 to about 3000 psig, preferably about 200 to about 2000 psig; a hydrogen circulation rate of about 500 to about 15,000/bbl; and a space velocity of about 0.1 to about 10 LHSV.

The catalysts useful in dewaxing include those zeolites which are shape selective. Preferred zeolites for the present invention are those having a constraint index in the approximate range of 1 to 12. Constraint Index (CI) values for some typical zeolites are:

| ZEOLITE | CI |
|---|---|
| ZSM-5 | 8.3 |
| ZSM-11 | 8.7 |
| ZSM-12 | 2 |
| ZSM-23 | 9.1 |
| ZSM-38 | 2 |
| ZSM-35 | 4.5 |
| TMA Offretite | 3.7 |
| Beta | 0.6 |
| ZSM-4 | 0.5 |
| H—Zeolon | 0.4 |
| REY | 0.4 |
| Amorphous Silica-Alumina | 0.6 |
| Erionite | 38 |

The preferred class of zeolites defined herein exemplified by ZSM-5, ZSM-11, ZSM-12, ZSM-23, ZSM-35, ZSM-38, ZSM-48, and other similar materials. U.S. Pat. No. 3,702,886 describing and claiming ZSM-5 is incorporated herein by reference.

ZSM-11 is more particularly described in U.S. Pat. No. 3,709,979, the entire contents of which are incorporated herein by reference.

ZSM-12 is more particularly described in U.S. Pat. No. 3,832,449, the entire contents of which are incorporated herein by reference.

ZSM-23 is more particularly described in U.S. Pat. No. 4,076,242, the entire contents of which are incorporated herein by reference.

ZSM-35 is more particularly described in U.S. Pat. No. 4,016,245, the entire contents of which are incorporated herein by reference.

ZSM-38 is more particularly described in U.S. Pat. No. 4,046,859, the entire contents of which are incorporated herein by reference.

ZSM-48 is more particularly described in U.S. Pat. No. 4,397,827, the entire contents of which are incorporated herein by reference.

In addition to those zeolites, the invention in its broader aspects of zeolites having a silica/alumina ratio above 12 also contemplates such zeolites as Beta, described in U.S. Pat. No. Re.28.341. The dewaxing catalyst may optionally contain a hydrogenation/dehydrogenation metal function such as Group VIII metals, including, but not limited to, Pt, Pd and Ni.

EXAMPLES 3, 4, and 5

A hydrotreated atmospheric resid obtained from a commercial resid desulfurization unit was distilled and the 650° F.–750° F. fraction was collected, Table 3. This 650°–750° F. vacuum gas oil has a pour point of 60° F., and cannot be blended into the distillate pool (Table 3). The 650°–750° F. vacuum gas oil was dewaxed at 725° F., 1.0 WHSV, and 400 psig pressure with Pt/zeolite-Beta, Pd/zeolite-Beta, and Pt/ZSM-23 separately. The results are summarized in Table 4. All three catalysts show an excellent dewaxing capability. The dewaxed 330° F.+ products have a pour point lower than −50° F. Furthermore, dewaxing does not lower cetane index (Table 4). These low pour 330° F.+ distillates can be directly blended into the distillate pool.

TABLE 3

| Properties of desulfurized 650–750° F. vacuum gas oil | |
|---|---|
| Gravity, API° | 31.5 |
| H, wt % | 13.3% |
| S, wt % | 0.06% |
| N, ppm | 180 |
| Distillation °F. | |
| IBP | 639 |
| 10% | 696 |
| 30% | 705 |
| 50% | 715 |
| 70% | 728 |
| 90% | 747 |
| EP | 766 |

TABLE 4

| Dewaxing of desulfurized 650–750° F. vacuum gas oil(1) | | | | |
|---|---|---|---|---|
| 330° F. + product | Feed | Pt/zeolite-Beta(2) | Pd/zeolite-Beta(3) | Pt/ZSM-23(4) |
| yield, wt % | 100 | 91 | 97 | 88 |
| pour, °F. | 60 | −65 | −50 | −65 |
| Cetane Index | 67 | 65 | 67 | 65 |
| Sulfur, wt % | 0.06 | 0.01 | 0.05 | 0.06 |

(1)conditions: 400 psig, 725° F., and 1 WHSV.
(2)0.6 wt % Pt on 65% zeolite-Beta/35% $Al_2O_3$ extrudates
(3)0.6 wt % Pd on 65% zeolite-Beta/35% $Al_2O_3$ extrudates
(4)0.6 wt % Pt on 65% ZSM-23/35% $Al_2O_3$ extrudates By referring to the FIGURE, the process of the present invention can be further described. A resid such as an atmospheric or vacuum resid enters desulfurization reactor 1 via line 2. Hydrogen via line 3 can be mixed with the resid prior to entering the desulfurization reactor. After desulfurization at conventional desulfurization conditions, the product leaves desulfurization reactor 1 via line 4 and is directed to separator 5 wherein gases such as hydrogen sulfide, ammonia, and light $C_1$–$C_4$ hydrocarbon gases are separated from the hydrocracked product. The desulfurized product is then directed to fractionator 7 via line 6 wherein the desulfurized product can be divided into gasoline products ($C_5$−380° F.), a 380°–650° F. distillate, a 650°–775° F. distillate and a 775° F.+ bottom fraction. Only the 650°–775° F. distillate fraction is directed to dewaxing reactor 10 via line 8. Hydrogen via line 9 is mixed with the distillate entering the dewaxing reactor. The dewaxed product leaves dewaxing reactor 10 via line 11 and is directed to separator 12 to again remove hydrogen and light $C_1$–$C_4$ gases. The product leaving separator 12 via line 13 can then be fractionated into a gasoline boiling range fraction and a distillate fraction in fractionator 14 as shown.

The present invention is beneficial inasmuch as distillate yield from a resid can be increased without over-dewaxing the 650° F.− products and 775° F.+ bottom fraction from the desulfurization unit. Additionally, distillate yield can be increased by introducing a distillate-selective, dewaxing catalyst such as Zeolite Beta subsequent to hydrodesulfurization. In this mode of operation, the product characteristics of the 380°–650° F. and 775° F.+ fractions from the desulfurization unit remain unchanged, or such fractions can be dewaxed but at different process conditions to provide more individual treatment of these fractions. Further, the life of the dewaxing catalyst can be extended since the catalyst only processes a fraction, i.e., about 20%, of the hydrodesulfurized product and would not be poisoned by residual metals or asphaltenes in the back end, i.e., greater than 1000° F. boiling point, of the product.

What is claimed is:

1. In a process for catalytically desulfurizing a petroleum residua feedstock and subsequently catalytically dewaxing the desulfurized feedstock with a shape selective zeolite catalyst, the improvement comprising: separating a fraction having a boiling range of about 650°-775° F. from the distillate product formed by desulfurization and dewaxing said separated fraction alone by contacting said fraction with a shape selective zeolite catalyst.

2. The process of claim 1 wherein said shape selective catalyst is selected from the group consisting of Zeolite Beta, ZSM-5, ZSM-11, and ZSM-23 and mixtures thereof.

3. The process of claim 1 wherein said shape selective zeolite catalyst is Zeolite Beta.

4. The process of claim 1 wherein said shape selective zeolite catalyst is ZSM-5.

5. The process of claim 1 wherein said shape selective zeolite catalyst is ZSM-11.

6. The process of claim 1 wherein said shape selective zeolite catalyst is ZSM-23.

7. The process of claim 1 wherein said petroleum residua feedstock comprises atmospheric or vacuum petroleum resid, heavy whole petroleum crudes, crudes derived from shale oil, tar sands, coker gas oil, and petroleum stocks derived from the liquefaction of coal.

8. The process of claim 1 wherein said catalytic desulfurization step comprises desulfurizing in the presence of a catalyst comprising a Group VIB and Group VIII metal and the oxides or sulfides thereof.

9. The process of claim 1 wherein said desulfurization proceeds in the presence of hydrogen.

10. The process of claim 9 wherein said hydrodesulfurization is conducted under conditions comprising a temperature of 600°-870° F., a liquid hourly space velocity of 0.1 to 6.0, and a hydrogen pressure of about 200 psig to about 2000 psig.

11. The process of claim 1 wherein said dewaxing is conducted under conditions comprising a temperature of 500°-950° F., a space velocity of 0.1 to 10 LHSV, and a pressure of 100 to 3,000 psig.

12. The process of claim 11 wherein said dewaxing proceeds in the presence of hydrogen, said dewaxing catalyst containing hydrogenation/dehydrogenation metal functions.

13. The process of claim 12 wherein said hydrogenation/dehydrogenation metal function comprises Pt, Pd, or Ni or combinations thereof.

14. A process for improving the distillate yield of a petroleum residua feedstock comprising desulfurizing a hydrocarbon feedstock and subsequently fractionating the desulfurized product, separating a fraction having a boiling range of about 650°-775° F. and further reducung the sulfur content of said fraction by contacting said fraction with a catalyst comprising Pt/Zeolite Beta.

15. The process of claim 14 wherein said contacting step simultaneously dewaxes said fraction.

* * * * *